US007543906B2

(12) United States Patent
Benjamin et al.

(10) Patent No.: US 7,543,906 B2
(45) Date of Patent: Jun. 9, 2009

(54) FLUID EJECTION DEVICE WITH IDENTIFICATION CELLS

(75) Inventors: Trudy L. Benjamin, Portland, OR (US); Joseph M Torgerson, Philomath, OR (US); William S Eaton, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 117 days.

(21) Appl. No.: 11/849,078

(22) Filed: Aug. 31, 2007

(65) Prior Publication Data

US 2008/0043051 A1 Feb. 21, 2008

Related U.S. Application Data

(62) Division of application No. 10/827,135, filed on Apr. 19, 2004, now Pat. No. 7,278,703.

(51) Int. Cl.
*B41J 2/01* (2006.01)

(52) U.S. Cl. ..... 347/19

(58) Field of Classification Search ..... 347/5, 347/19, 50

See application file for complete search history.

(56) References Cited

U.S. PATENT DOCUMENTS

| | | | | |
|---|---|---|---|---|
| 5,431,673 | A | 7/1995 | Summers et al. | |
| 5,886,726 | A | 3/1999 | Pawelka et al. | |
| 6,039,428 | A | 3/2000 | Juve et al. | |
| 6,081,280 | A | 6/2000 | Bolash et al. | |
| 6,174,037 | B1 | 1/2001 | Donahue et al. | |
| 6,385,407 | B1 | 5/2002 | Inose | |
| 6,450,601 | B1 | 1/2003 | Furukawa et al. | |
| 7,278,703 | B2 * | 10/2007 | Benjamin et al. | 347/19 |
| 2002/0057305 | A1 | 5/2002 | Kao et al. | |
| 2002/0060722 | A1 | 5/2002 | Axtell et al. | |
| 2002/0140751 | A1 | 10/2002 | Imanaka et al. | |
| 2002/0145645 | A1 | 10/2002 | Aono et al. | |
| 2002/0175965 | A1 | 11/2002 | Skene et al. | |
| 2003/0002899 | A1 | 1/2003 | Furukawa et al. | |
| 2003/0030687 | A1 | 2/2003 | Hu et al. | |
| 2003/0146951 | A1 | 8/2003 | Skene et al. | |
| 2003/0146967 | A1 | 8/2003 | Miller | |

FOREIGN PATENT DOCUMENTS

| | | |
|---|---|---|
| EP | 0980758 | 11/2000 |
| EP | 1128324 | 8/2001 |
| EP | 0571093 | 8/2007 |
| WO | 89/03768 | 5/1989 |

* cited by examiner

*Primary Examiner*—Huan H Tran

(57) ABSTRACT

Embodiments of a fluid ejection device are disclosed.

20 Claims, 9 Drawing Sheets

FLUID EJECTION DEVICE WITH IDENTIFICATION CELLS

CROSS-REFERENCE TO RELATED APPLICATIONS

This patent application is a divisional of application Ser. No. 10/827,135, filed on Apr. 19, 2004, now U.S. Pat. No. 7,278,703 which is herein incorporated by reference.

BACKGROUND

An inkjet printing system, as one embodiment of a fluid ejection system, may include a printhead, an ink supply that provides liquid ink to the printhead, and an electronic controller that controls the printhead. The printhead, as one embodiment of a fluid ejection device, ejects ink drops through a plurality of orifices or nozzles. The ink is projected toward a print medium, such as a sheet of paper, to print an image onto the print medium. The nozzles are typically arranged in one or more arrays, such that properly sequenced ejection of ink from the nozzles causes characters or other images to be printed on the print medium as the printhead and the print medium are moved relative to each other.

In a typical thermal inkjet printing system, the printhead ejects ink drops through nozzles by rapidly heating small volumes of ink located in vaporization chambers. The ink is heated with small electric heaters, such as thin film resistors referred to herein as firing resistors. Heating the ink causes the ink to vaporize and be ejected through the nozzles.

To eject one drop of ink, the electronic controller that controls the printhead activates an electrical current from a power supply external to the printhead. The electrical current is passed through a selected firing resistor to heat the ink in a corresponding selected vaporization chamber and eject the ink through a corresponding nozzle. Known drop generators include a firing resistor, a corresponding vaporization chamber, and a corresponding nozzle.

In fluid ejection device it is desirable to have several characteristics of each print cartridge easily identifiable by a controller. Ideally the identification information should be supplied directly by the print cartridge. The "identification information" provides information to the controller to adjust the operation of the printer and ensures correct operation.

As the different types of fluid ejection devices and their operating parameters increase, there is a need to provide a greater amount of identification information. At the same time, it is not desirable to add further interconnections to the flex tab circuit or to increase the size of the die to provide such identification information.

For these and other reasons, there is a need for the present invention.

DETAILED DESCRIPTION

In the following detailed description, reference is made to the accompanying drawings which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments of the present invention can be positioned in a number of different orientations, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

Figure 1:
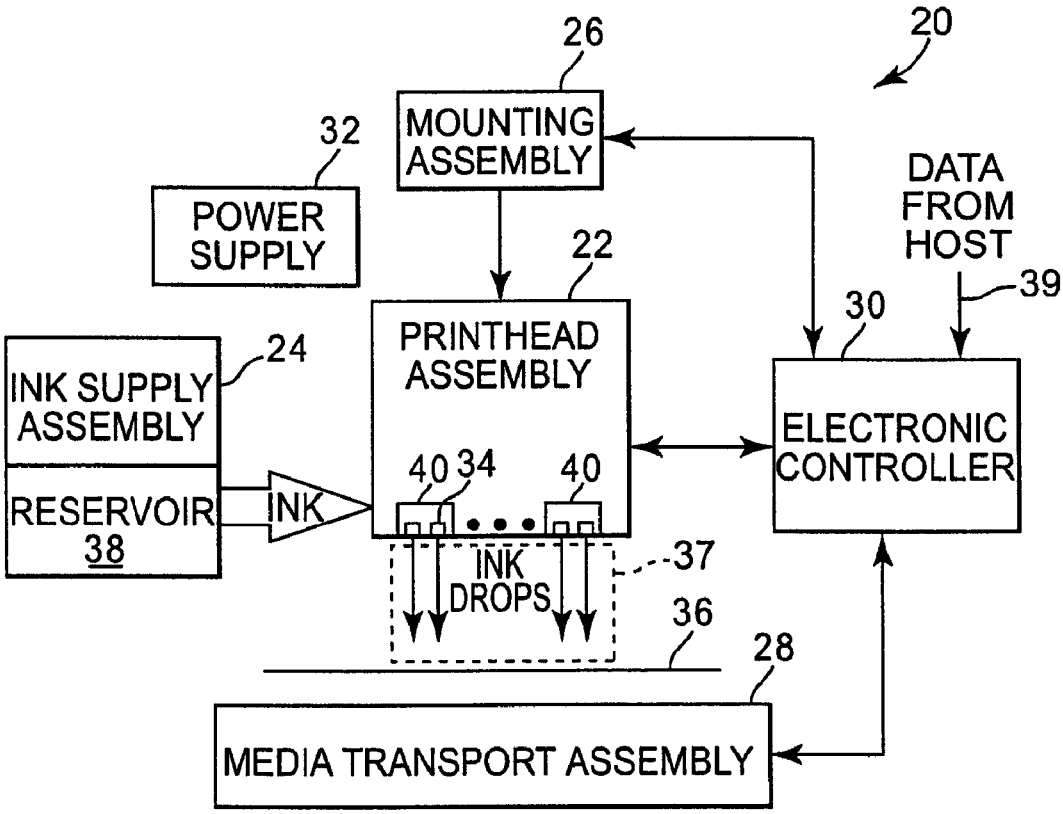
FIG. 1 illustrates one embodiment of an ink jet printing system.

FIG. 1 illustrates one embodiment of an inkjet printing system 20. Inkjet printing system 20 constitutes one embodiment of a fluid ejection system that includes a fluid ejection device, such as inkjet printhead assembly 22, and a fluid supply assembly, such as ink supply assembly 24. The inkjet printing system 20 also includes a mounting assembly 26, a media transport assembly 28, and an electronic controller 30. At least one power supply 32 provides power to the various electrical components of inkjet printing system 20.

In one embodiment, inkjet printhead assembly 22 includes at least one printhead or printhead die 40 that ejects drops of ink through a plurality of orifices or nozzles 34 toward a print medium 36 so as to print onto print medium 36. Printhead 40 is one embodiment of a fluid ejection device. Print medium 36 may be any type of suitable sheet material, such as paper, card stock, transparencies, Mylar, fabric, and the like. Typically, nozzles 34 are arranged in one or more columns or arrays such that properly sequenced ejection of ink from nozzles 34 causes characters, symbols, and/or other graphics or images to be printed upon print medium 36 as inkjet printhead assembly 22 and print medium 36 are moved relative to each other. While the following description refers to the ejection of ink from printhead assembly 22, it is understood that other liquids, fluids or flowable materials, including clear fluid, may be ejected from printhead assembly 22.

Ink supply assembly 24 as one embodiment of a fluid supply assembly provides ink to printhead assembly 22 and includes a reservoir 38 for storing ink. As such, ink flows from reservoir 38 to inkjet printhead assembly 22. Ink supply assembly 24 and inkjet printhead assembly 22 can form either a one-way ink delivery system or a recirculating ink delivery system. In a one-way ink delivery system, substantially all of the ink provided to inkjet printhead assembly 22 is consumed during printing. In a recirculating ink delivery system, only a portion of the ink provided to printhead assembly 22 is consumed during printing. As such, ink not consumed during printing is returned to ink supply assembly 24.

In one embodiment, inkjet printhead assembly 22 and ink supply assembly 24 are housed together in an inkjet cartridge or pen. The inkjet cartridge or pen is one embodiment of a fluid ejection device. In another embodiment, ink supply assembly 24 is separate from inkjet printhead assembly 22 and provides ink to inkjet printhead assembly 22 through an interface connection, such as a supply tube (not shown). In either embodiment, reservoir 38 of ink supply assembly 24 may be removed, replaced, and/or refilled. In one embodiment, where inkjet printhead assembly 22 and ink supply assembly 24 are housed together in an inkjet cartridge, reservoir 38 includes a local reservoir located within the cartridge and may also include a larger reservoir located separately from the cartridge. As such, the separate, larger reservoir serves to refill the local reservoir. Accordingly, the separate, larger reservoir and/or the local reservoir may be removed, replaced, and/or refilled.

Mounting assembly 26 positions inkjet printhead assembly 22 relative to media transport assembly 28 and media transport assembly 28 positions print medium 36 relative to inkjet printhead assembly 22. Thus, a print zone 37 is defined adjacent to nozzles 34 in an area between inkjet printhead assembly 22 and print medium 36. In one embodiment, inkjet printhead assembly 22 is a scanning type printhead assembly. As such, mounting assembly 26 includes a carriage (not shown) for moving inkjet printhead assembly 22 relative to media transport assembly 28 to scan print medium 36. In another embodiment, inkjet printhead assembly 22 is a non-scanning type printhead assembly. As such, mounting assembly 26 fixes inkjet printhead assembly 22 at a prescribed position relative to media transport assembly 28. Thus, media transport assembly 28 positions print medium 36 relative to inkjet printhead assembly 22.

Electronic controller or printer controller 30 typically includes a processor, firmware, and other electronics, or any combination thereof, for communicating with and controlling inkjet printhead assembly 22, mounting assembly 26, and media transport assembly 28. Electronic controller 30 receives data 39 from a host system, such as a computer, and usually includes memory for temporarily storing data 39. Typically, data 39 is sent to inkjet printing system 20 along an electronic, infrared, optical, or other information transfer path. Data 39 represents, for example, a document and/or file to be printed. As such, data 39 forms a print job for inkjet printing system 20 and includes one or more print job commands and/or command parameters.

In one embodiment, electronic controller 30 controls inkjet printhead assembly 22 for ejection of ink drops from nozzles 34. As such, electronic controller 30 defines a pattern of ejected ink drops that form characters, symbols, and/or other graphics or images on print medium 36. The pattern of ejected ink drops is determined by the print job commands and/or command parameters.

In one embodiment, inkjet printhead assembly 22 includes one printhead 40. In another embodiment, inkjet printhead assembly 22 is a wide-array or multi-head printhead assembly. In one wide-array embodiment, inkjet printhead assembly 22 includes a carrier, which carries printhead dies 40, provides electrical communication between printhead dies 40 and electronic controller 30, and provides fluidic communication between printhead dies 40 and ink supply assembly 24.

Figure 2:
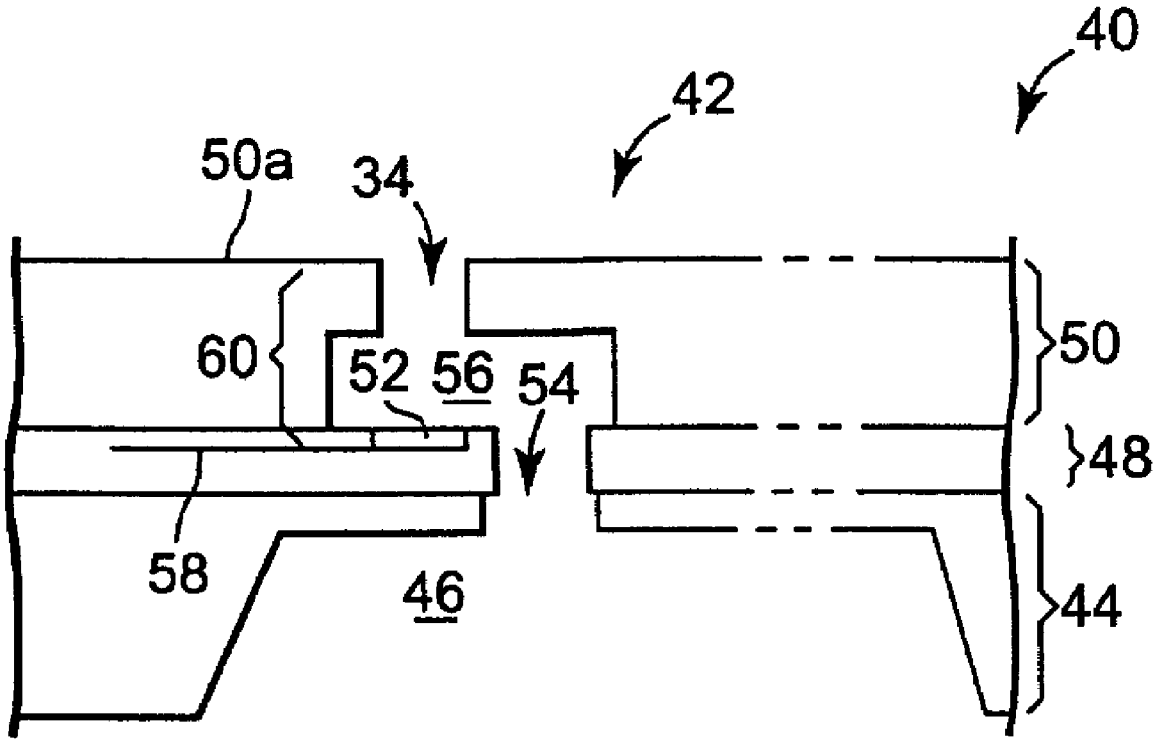
FIG. 2 is a diagram illustrating a portion of one embodiment of a printhead die.

FIG. 2 is a diagram illustrating a portion of one embodiment of a printhead die 40. The printhead die 40 includes an array of printing or fluid ejecting elements 42. Printing elements 42 are formed on a substrate 44, which has an ink feed slot 46 formed therein. As such, ink feed slot 46 provides a supply of liquid ink to printing elements 42. Ink feed slot 46 is one embodiment of a fluid feed source. Other embodiments of fluid feed sources include but are not limited to corresponding individual ink feed holes feeding corresponding vaporization chambers and multiple shorter ink feed trenches that each feed corresponding groups of fluid ejecting elements. A thin-film structure 48 has an ink feed channel 54 formed therein which communicates with ink feed slot 46 formed in substrate 44. An orifice layer 50 has a front face 50*a* and a nozzle opening 34 formed in front face 50*a*. Orifice layer 50 also has a nozzle chamber or vaporization chamber 56 formed therein which communicates with nozzle opening 34 and ink feed channel 54 of thin-film structure 48. A firing resistor 52 is positioned within vaporization chamber 56 and leads 58 electrically couple firing resistor 52 to circuitry controlling the application of electrical current through selected firing resistors. A drop generator 60 as referred to herein includes firing resistor 52, nozzle chamber or vaporization chamber 56 and nozzle opening 34.

During printing, ink flows from ink feed slot 46 to vaporization chamber 56 via ink feed channel 54. Nozzle opening 34 is operatively associated with firing resistor 52 such that droplets of ink within vaporization chamber 56 are ejected through nozzle opening 34 (e.g., substantially normal to the plane of firing resistor 52) and toward print medium 36 upon energizing of firing resistor 52.

Example embodiments of printhead dies 40 include a thermal printhead, a piezoelectric printhead, an electrostatic printhead, or any other type of fluid ejection device known in the art that can be integrated into a multi-layer structure. Substrate 44 is formed, for example, of silicon, glass, ceramic, or a stable polymer and thin-film structure 48 is formed to include one or more passivation or insulation layers of silicon dioxide, silicon carbide, silicon nitride, tantalum, polysilicon glass, or other suitable material. Thin-film structure 48, also, includes at least one conductive layer, which defines firing resistor 52 and leads 58. In one embodiment, the conductive layer comprises, for example, aluminum, gold, tantalum, tantalum-aluminum, or other metal or metal alloy. In one embodiment, firing cell circuitry, such as described in detail below, is implemented in substrate and thin-film layers, such as substrate 44 and thin-film structure 48.

In one embodiment, orifice layer 50 comprises a photoimageable epoxy resin, for example, an epoxy referred to as SU8, marketed by Micro-Chem, Newton, Mass. Exemplary techniques for fabricating orifice layer 50 with SU8 or other polymers are described in detail in U.S. Pat. No. 6,162,589, which is herein incorporated by reference. In one embodiment, orifice layer 50 is formed of two separate layers referred to as a barrier layer (e.g., a dry film photo resist barrier layer) and a metal orifice layer (e.g., a nickel, copper, iron/nickel alloys, palladium, gold, or rhodium layer) formed over the barrier layer. Other suitable materials, however, can be employed to form orifice layer 50.

Figure 3:
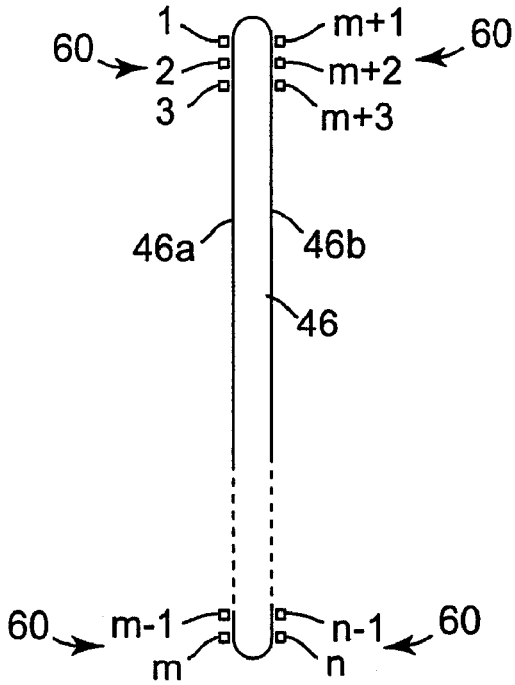
FIG. 3 is a diagram illustrating a layout of drop generators located along an ink feed slot in the one embodiment of a printhead die.

FIG. 3 is a diagram illustrating drop generators 60 located along ink feed slot 46 in one embodiment of printhead die 40. Ink feed slot 46 includes opposing ink feed slot sides 46*a* and 46*b*. Drop generators 60 are disposed along each of the opposing ink feed slot sides 46*a* and 46*b*. A total of n drop generators 60 are located along ink feed slot 46, with m drop generators 60 located along ink feed slot side 46*a*, and n−m drop generators 60 located along ink feed slot side 46*b*. In one embodiment, n equals 200 drop generators 60 located along ink feed slot 46 and m equals 100 drop generators 60 located along each of the opposing ink feed slot sides 46*a* and 46*b*. In other embodiments, any suitable number of drop generators 60 can be disposed along ink feed slot 46.

Ink feed slot 46 provides ink to each of the n drop generators 60 disposed along ink feed slot 46. Each of the n drop generators 60 includes a firing resistor 52, a vaporization chamber 56 and a nozzle 34. Each of the n vaporization chambers 56 is fluidically coupled to ink feed slot 46 through at least one ink feed channel 54. The firing resistors 52 of drop generators 60 are energized in a controlled sequence to eject fluid from vaporization chambers 56 and through nozzles 34 to print an image on print medium 36.

Figure 4:
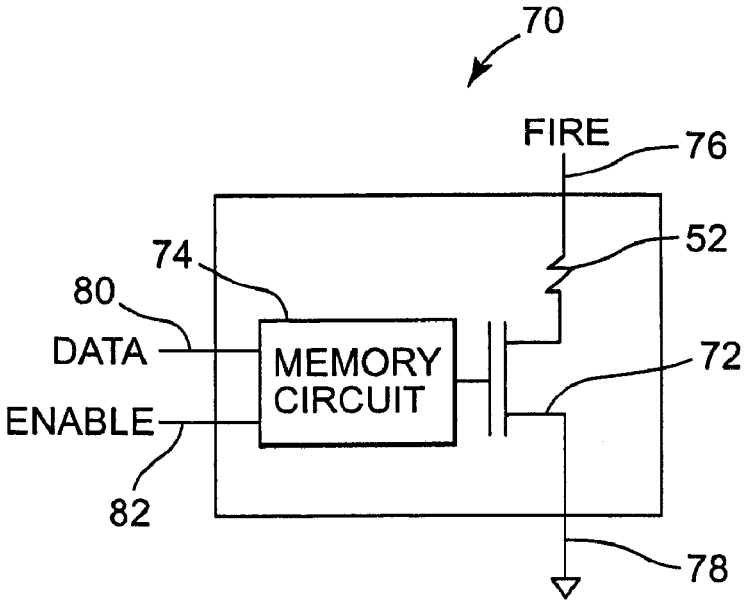
FIG. 4 is a diagram illustrating one embodiment of a firing cell employed in one embodiment of a printhead die.

FIG. 4 is a diagram illustrating one embodiment of a firing cell 70 employed in one embodiment of printhead die 40. Firing cell 70 includes a firing resistor 52, a resistor drive switch 72, and a memory circuit 74. Firing resistor 52 is part of a drop generator 60. Drive switch 72 and memory circuit 74 are part of the circuitry that controls the application of electrical current through firing resistor 52. Firing cell 70 is formed in thin-film structure 48 and on substrate 44.

In one embodiment, firing resistor 52 is a thin-film resistor and drive switch 72 is a field effect transistor (FET). Firing resistor 52 is electrically coupled to a fire line 76 and the drain-source path of drive switch 72. The drain-source path of drive switch 72 is also electrically coupled to a reference line 78 that is coupled to a reference voltage, such as ground. The gate of drive switch 72 is electrically coupled to memory circuit 74 that controls the state of drive switch 72.

Memory circuit 74 is electrically coupled to a data line 80 and enable lines 82. Data line 80 receives a data signal that represents part of an image and enable lines 82 receive enable signals to control operation of memory circuit 74. Memory circuit 74 stores one bit of data as it is enabled by the enable signals. The logic level of the stored data bit sets the state (e.g., on or off, conducting or non-conducting) of drive switch 72. The enable signals can include one or more select signals and one or more address signals.

Fire line 76 receives an energy signal comprising energy pulses and provides an energy pulse to firing resistor 52. In one embodiment, the energy pulses are provided by electronic controller 30 to have timed starting times and timed duration to provide a proper amount of energy to heat and vaporize fluid in the vaporization chamber 56 of a drop generator 60. If drive switch 72 is on (conducting), the energy pulse heats firing resistor 52 to heat and eject fluid from drop generator 60. If drive switch 72 is off (non-conducting), the energy pulse does not heat firing resistor 52 and the fluid remains in drop generator 60.

Figure 5:
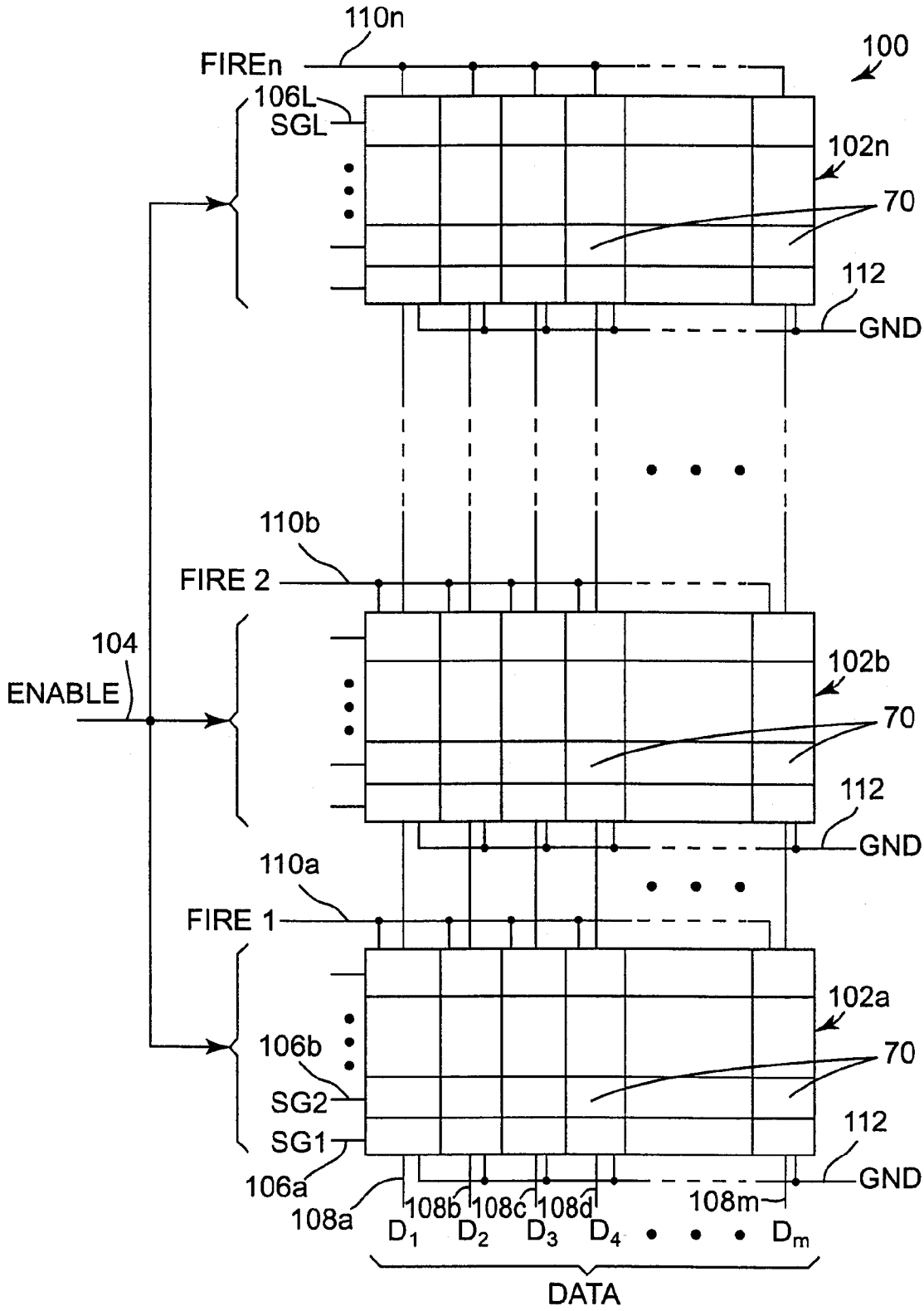
FIG. 5 is a schematic diagram illustrating one embodiment of an ink jet printhead firing cell array.

FIG. 5 is a schematic diagram illustrating one embodiment of an inkjet printhead firing cell array, indicated at 100. Firing cell array 100 includes a plurality of firing cells 70 arranged into n fire groups 102*a*-102*n*. In one embodiment, firing cells 70 are arranged into six fire groups 102*a*-102*n*. In other embodiments, firing cells 70 can be arranged into any suitable number of fire groups 102*a*-102*n*, such as four or more fire groups 102*a*-102*n*.

The firing cells 70 in array 100 are schematically arranged into L rows and m columns. The L rows of firing cells 70 are electrically coupled to enable lines 104 that receive enable signals. Each row of firing cells 70, referred to herein as a row subgroup or subgroup of firing cells 70, is electrically coupled to one set of subgroup enable lines 106*a*-106L. The subgroup enable lines 106*a*-106L receive subgroup enable signals SG1, SG2, . . . $SG_L$ that enable the corresponding subgroup of firing cells 70.

The m columns are electrically coupled to m data lines 108*a*-108*m* that receive data signals D1, D2 . . . Dm, respectively. Each of the m columns includes firing cells 70 in each of the n fire groups 102*a*-102*n* and each column of firing cells 70, referred to herein as a data line group or data group, is electrically coupled to one of the data lines 108*a*-108*m*. In other words, each of the data lines 108*a*-108*m* is electrically coupled to each of the firing cells 70 in one column, including firing cells 70 in each of the fire groups 102*a*-102*n*. For example, data line 108*a* is electrically coupled to each of the firing cells 70 in the far left column, including firing cells 70 in each of the fire groups 102*a*-102*n*. Data line 108*b* is electrically coupled to each of the firing cells 70 in the adjacent column and so on, over to and including data line 108*m* that is electrically coupled to each of the firing cells 70 in the far right column, including firing cells 70 in each of the fire groups 102*a*-102*n*.

In one embodiment, array 100 is arranged into six fire groups 102*a*-102*n* and each of the six fire groups 102*a*-102*n* includes 13 subgroups and eight data line groups. In other embodiments, array 100 can be arranged into any suitable number of fire groups 102*a*-102*n* and into any suitable number of subgroups and data line groups. In any embodiment, fire groups 102*a*-102*n* are not limited to having the same number of subgroups and data line groups. Instead, each of the fire groups 102*a*-102*n* can have a different number of subgroups and/or data line groups as compared to any other fire group 102*a*-102*n*. In addition, each subgroup can have a different number of firing cells 70 as compared to any other subgroup, and each data line group can have a different number of firing cells 70 as compared to any other data line group.

The firing cells 70 in each of the fire groups 102*a*-102*n* are electrically coupled to one of the fire lines 110*a*-110*n*. In fire group 102*a*, each of the firing cells 70 is electrically coupled to fire line 110*a* that receives fire signal or energy signal FIRE1. In fire group 102*b*, each of the firing cells 70 is electrically coupled to fire line 110*b* that receives fire signal or energy signal FIRE2 and so on, up to and including fire group 102*n* wherein each of the firing cells 70 is electrically coupled to fire line 110*n* that receives fire signal or energy signal FIREn. In addition, each of the firing cells 70 in each of the fire groups 102*a*-102*n* is electrically coupled to a common reference line 112 that is tied to ground.

In operation, subgroup enable signals SG1, SG2, . . . $SG_L$ are provided on subgroup enable lines 106*a*-106L to enable one subgroup of firing cells 70. The enabled firing cells 70 store data signals D1, D2 . . . Dm provided on data lines 108*a*-108*m*. The data signals D1, D2 . . . Dm are stored in memory circuits 74 of enabled firing cells 70. Each of the stored data signals D1, D2 . . . Dm sets the state of drive switch 72 in one of the enabled firing cells 70. The drive switch 72 is set to conduct or not conduct based on the stored data signal value.

After the states of the selected drive switches 72 are set, an energy signal FIRE1-FIREn is provided on the fire line 110*a*-110*n* corresponding to the fire group 102*a*-102*n* that includes the selected subgroup of firing cells 70. The energy signal FIRE1-FIREn includes an energy pulse. The energy pulse is provided on the selected fire line 110*a*-110*n* to energize firing resistors 52 in firing cells 70 that have conducting drive switches 72. The energized firing resistors 52 heat and eject ink onto print medium 36 to print an image represented by data signals D1, D2 . . . Dm. The process of enabling a subgroup of firing cells 70, storing data signals D1, D2 . . . Dm in the enabled subgroup and providing an energy signal FIRE1-FIREn to energize firing resistors 52 in the enabled subgroup continues until printing stops.

In one embodiment, as an energy signal FIRE1-FIREn is provided to a selected fire group 102*a*-102*n*, subgroup enable signals SG1, SG2, . . . $SG_L$ change to select and enable another subgroup in a different fire group 102*a*-102*n*. The newly enabled subgroup stores data signals D1, D2 . . . Dm provided on data lines 108*a*-108*m* and an energy signal FIRE1-FIREn is provided on one of the fire lines 110*a*-110*n* to energize firing resistors 52 in the newly enabled firing cells 70. At any one time, only one subgroup of firing cells 70 is enabled by subgroup enable signals SG1, SG2, . . . $SG_L$ to store data signals D1, D2 . . . Dm provided on data lines 108*a*-108*m*. In this aspect, data signals D1, D2 Dm on data lines 108*a*-108*m* are timed division multiplexed data signals. Also, only one subgroup in a selected fire group 102*a*-102*n* includes drive switches 72 that are set to conduct while an energy signal FIRE1-FIREn is provided to the selected fire group 102*a*-102*n*. However, energy signals FIRE1-FIREn provided to different fire groups 102*a*-102*n* can and do overlap.

Figure 6:
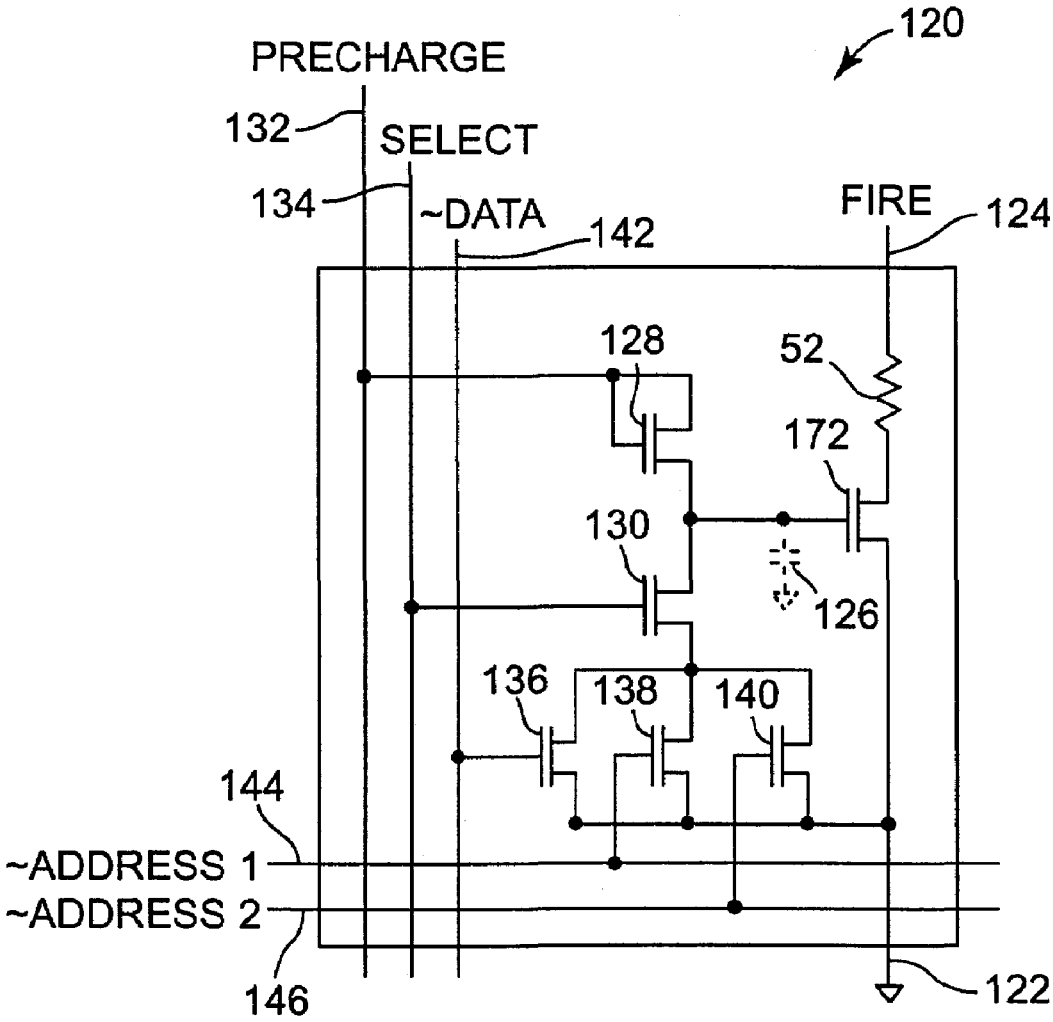
FIG. 6 is a schematic diagram illustrating one embodiment of a pre-charged firing cell.

FIG. 6 is a schematic diagram illustrating one embodiment of a pre-charged firing cell 120. Pre-charged firing cell 120 is one embodiment of firing cell 70. The pre-charged firing cell 120 includes a drive switch 172 electrically coupled to a firing resistor 52. In one embodiment, drive switch 172 is a FET including a drain-source path electrically coupled at one end to one terminal of firing resistor 52 and at the other end to a reference line 122. The reference line 122 is tied to a reference voltage, such as ground. The other terminal of firing resistor 52 is electrically coupled to a fire line 124 that receives a fire signal or energy signal FIRE including energy pulses. The energy pulses energize firing resistor 52 if drive switch 172 is on (conducting).

The gate of drive switch 172 forms a storage node capacitance 126 that functions as a memory element to store data pursuant to the sequential activation of a pre-charge transistor 128 and a select transistor 130. The drain-source path and gate of pre-charge transistor 128 are electrically coupled to a pre-charge line 132 that receives a pre-charge signal. The gate of drive switch 172 is electrically coupled to the drain-source path of pre-charge transistor 128 and the drain-source path of select transistor 130. The gate of select transistor 130 is electrically coupled to a select line 134 that receives a select signal. The storage node capacitance 126 is shown in dashed lines, as it is part of drive switch 172. Alternatively, a capacitor separate from drive switch 172 can be used as a memory element.

A data transistor 136, a first address transistor 138 and a second address transistor 140 include drain-source paths that are electrically coupled in parallel. The parallel combination of data transistor 136, first address transistor 138 and second address transistor 140 is electrically coupled between the drain-source path of select transistor 130 and reference line 122. The serial circuit including select transistor 130 coupled to the parallel combination of data transistor 136, first address transistor 138 and second address transistor 140 is electrically coupled across node capacitance 126 of drive switch 172. The gate of data transistor 136 is electrically coupled to data line 142 that receives data signals ~DATA. The gate of first address transistor 138 is electrically coupled to an address line 144 that receives address signals ~ADDRESS1 and the gate of second address transistor 140 is electrically coupled to a second address line 146 that receives address signals ~ADDRESS2. The data signals ~DATA and address signals ~ADDRESS1 and ~ADDRESS2 are active when low as indicated by the tilda (~) at the beginning of the signal name. The node capacitance 126, pre-charge transistor 128, select transistor 130, data transistor 136 and address transistors 138 and 140 form a memory cell.

In operation, node capacitance 126 is pre-charged through pre-charge transistor 128 by providing a high level voltage pulse on pre-charge line 132. In one embodiment, after the high level voltage pulse on pre-charge line 132, a data signal ~DATA is provided on data line 142 to set the state of data transistor 136 and address signals ~ADDRESS1 and ~ADDRESS2 are provided on address lines 144 and 146 to set the states of first address transistor 138 and second address transistor 140. A voltage pulse of sufficient magnitude is provided on select line 134 to turn on select transistor 130 and node capacitance 126 discharges if data transistor 136, first address transistor 138 and/or second address transistor 140 is on. Alternatively, node capacitance 126 remains charged if data transistor 136, first address transistor 138 and second address transistor 140 are all off.

Pre-charged firing cell 120 is an addressed firing cell if both address signals ~ADDRESS1 and ~ADDRESS2 are low and node capacitance 126 either discharges if data signal ~DATA is high or remains charged if data signal ~DATA is low. Pre-charged firing cell 120 is not an addressed firing cell if at least one of the address signals ~ADDRESS1 and ~ADDRESS2 is high and node capacitance 126 discharges regardless of the data signal ~DATA voltage level. The first and second address transistors 136 and 138 comprise an address decoder, and data transistor 136 controls the voltage level on node capacitance 126 if pre-charged firing cell 120 is addressed.

Pre-charged firing cell 120 may utilize any number of other topologies or arrangements, as long as the operational relationships described above are maintained. For example, an OR gate may be coupled to address lines 144 and 146, the output of which is coupled to a single transistor.

Figure 7:
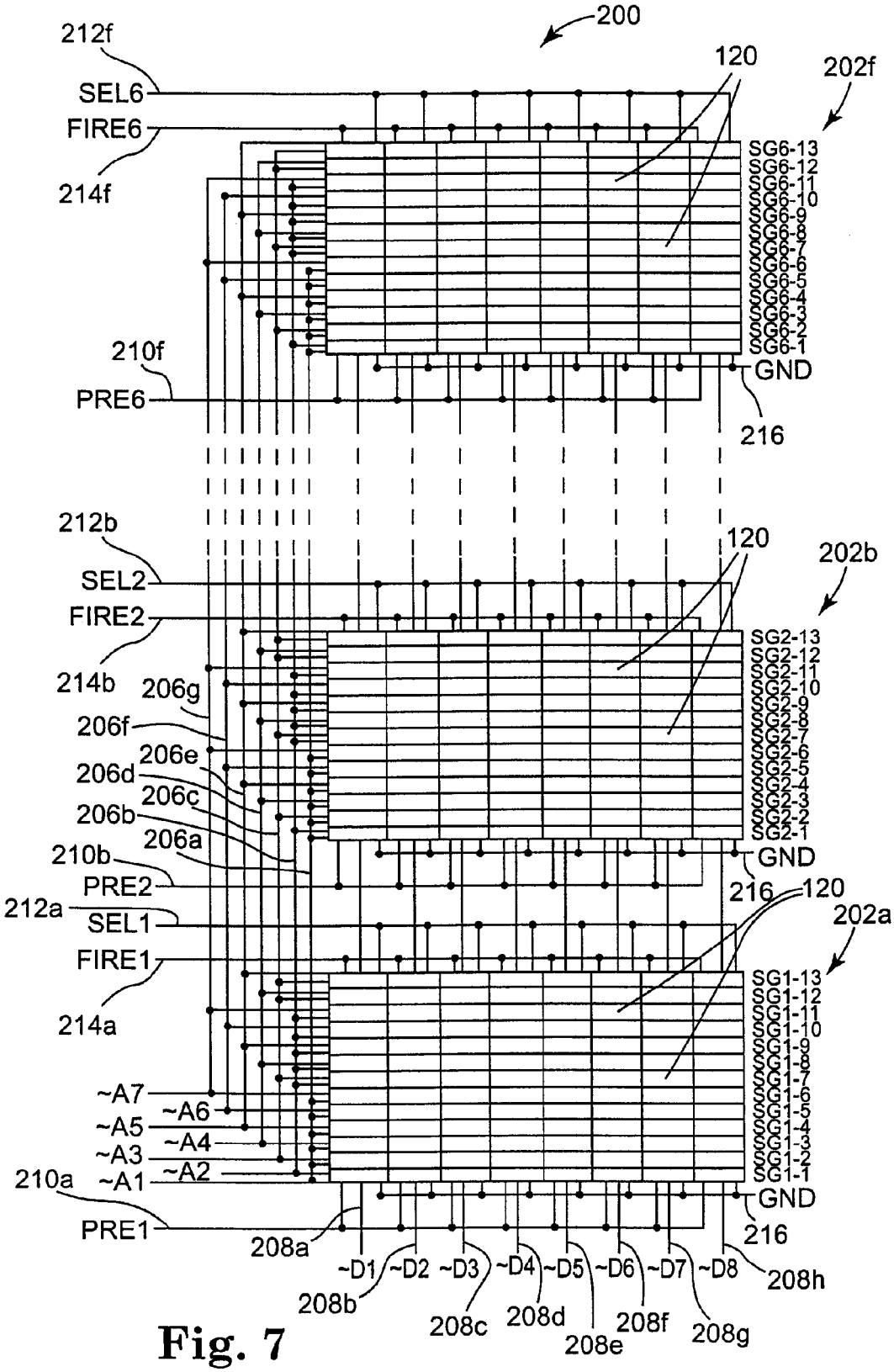
FIG. 7 is a schematic diagram illustrating one embodiment of an ink jet printhead firing cell array.

FIG. 7 is a schematic diagram illustrating one embodiment of an inkjet printhead firing cell array 200. Firing cell array 200 includes a plurality of pre-charged firing cells 120 arranged into six-fire groups 202*a*-202*f*. The pre-charged firing cells 120 in each fire group 202*a*-202*f* are schematically arranged into 13 rows and eight columns. The fire groups 202*a*-202*f* and pre-charged firing cells 120 in array 200 are schematically arranged into 78 rows and eight columns, although the number of pre-charged firing cells and their layout may vary as desired.

The eight columns of pre-charged firing cells 120 are electrically coupled to eight data lines 208*a*-208*h* that receive data signals ~D1, ~D2 . . . ~D8, respectively. Each of the eight columns, referred to herein as a data line group or data group, includes pre-charged firing cells 120 in each of the six fire groups 202*a*-202*f*. Each of the firing cells 120 in each column of pre-charged firing cells 120 is electrically coupled to one of the data lines 208*a*-208*h*. All pre-charged firing cells 120 in a data line group are electrically coupled to the same data line 208*a*-208*h* that is electrically coupled to the gates of the data transistors 136 in the pre-charged firing cells 120 in the column.

Data line 208*a* is electrically coupled to each of the pre-charged firing cells 120 in the far left column, including pre-charged firing cells in each of the fire groups 202*a*-202*f*. Data line 208*b* is electrically coupled to each of the pre-charged firing cells 120 in the adjacent column and so on, over to and including data line 208*h* that is electrically coupled to each of the pre-charged firing cells 120 in the far right column, including pre-charged firing cells 120 in each of the fire groups 202*a*-202*f*.

The rows of pre-charged firing cells 120 are electrically coupled to address lines 206*a*-206*g* that receive address signals ~A1, ~A2 . . . ~A7, respectively. Each pre-charged firing cell 120 in a row of pre-charged firing cells 120, referred to herein as a row subgroup or subgroup of pre-charged firing cells 120, is electrically coupled to two of the address lines 206*a*-206*g*. All pre-charged firing cells 120 in a row subgroup are electrically coupled to the same two address lines 206*a*-206*g*.

The subgroups of the fire groups 202*a*-202*f* are identified as subgroups SG1-1 through SG1-13 in fire group one (FG1) 202*a*, subgroups SG2-1 through SG2-13 in fire group two (FG2) 202*b* and so on, up to and including subgroups SG6-1 through SG6-13 in fire group six (FG6) 202*f*. In other embodiments, each fire group 202*a*-202*f* can include any suitable number of subgroups, such as 14 or more subgroups.

Each subgroup of pre-charged firing cells 120 is electrically coupled to two address lines 206*a*-206*g*. The two address lines 206*a*-206*g* corresponding to a subgroup are electrically coupled to the first and second address transistors 138 and 140 in all pre-charged firing cells 120 of the subgroup. One address line 206*a*-206*g* is electrically coupled to the gate of one of the first and second address transistors 138 and 140 and the other address line 206*a*-206*g* is electrically coupled to the gate of the other one of the first and second address transistors 138 and 140. The address lines 206*a*-206*g* receive address signals ~A1, ~A2 . . . ~A7 and are coupled to provide the address signals ~A1, ~A2 . . . ~A7 to the subgroups of the array 200 as follows:

| Row Subgroup Address Signals | Row Subgroups |
|---|---|
| ~A1, ~A2 | SG1-1, SG2-1 . . . SG6-1 |
| ~A1, ~A3 | SG1-2, SG2-2 . . . SG6-2 |
| ~A1, ~A4 | SG1-3, SG2-3 . . . SG6-3 |
| ~A1, ~A5 | SG1-4, SG2-4 . . . SG6-4 |
| ~A1, ~A6 | SG1-5, SG2-5 . . . SG6-5 |
| ~A1, ~A7 | SG1-6, SG2-6 . . . SG6-6 |
| ~A2, ~A3 | SG1-7, SG2-7 . . . SG6-7 |
| ~A2, ~A4 | SG1-8, SG2-8 . . . SG6-8 |
| ~A2, ~A5 | SG1-9, SG2-9 . . . SG6-9 |
| ~A2, ~A6 | SG1-10, SG2-10 . . . SG6-10 |
| ~A2, ~A7 | SG1-11, SG2-11 . . . SG6-11 |
| ~A3, ~A4 | SG1-12, SG2-12 . . . SG6-12 |
| ~A3, ~A5 | SG1-13, SG2-13 . . . SG6-13 |

Subgroups of pre-charged firing cells 120 are addressed by providing address signals ~A1, ~A2 . . . ~A7 on address lines 206*a*-206*g*. In one embodiment, the address lines 206*a*-206*g* are electrically coupled to one or more address generators provided on printhead die 40.

Pre-charge lines 210*a*-210*f* receive pre-charge signals PRE1, PRE2 . . . PRE6 and provide the pre-charge signals PRE1, PRE2 . . . PRE6 to corresponding fire groups 202*a*-202*f*. Pre-charge line 210*a* is electrically coupled to all of the pre-charged firing cells 120 in FG1 202*a*. Pre-charge line 210*b* is electrically coupled to all pre-charged firing cells 120 in FG2 202*b* and so on, up to and including pre-charge line 210*f* that is electrically coupled to all pre-charged firing cells 120 in FG6 202*f*. Each of the pre-charge lines 210*a*-210*f* is electrically coupled to the gate and drain-source path of all of the pre-charge transistors 128 in the corresponding fire group 202*a*-202*f*, and all pre-charged firing cells 120 in a fire group 202*a*-202*f* are electrically coupled to only one pre-charge line 210*a*-210*f*. Thus, the node capacitances 126 of all pre-charged firing cells 120 in a fire group 202*a*-202*f* are charged by providing the corresponding pre-charge signal PRE1, PRE2 . . . PRE6 to the corresponding pre-charge line 210*a*-210*f*.

Select lines 212*a*-212*f* receive select signals SEL1, SEL2 . . . SEL6 and provide the select signals SEL1, SEL2 . . . SEL6 to corresponding fire groups 202*a*-202*f*. Select line 212*a* is electrically coupled to all pre-charged firing cells 120 in FG1 202*a*. Select line 212*b* is electrically coupled to all pre-charged firing cells 120 in FG2 202*b* and so on, up to and including select line 212*f* that is electrically coupled to all pre-charged firing cells 120 in FG6 202*f*. Each of the select lines 212*a*-212*f* is electrically coupled to the gate of all of the select transistors 130 in the corresponding fire group 202*a*-202*f*, and all pre-charged firing cells 120 in a fire group 202*a*-202*f* are electrically coupled to only one select line 212*a*-212*f*.

Fire lines 214*a*-214*f* receive fire signals or energy signals FIRE1, FIRE2 . . . FIRE6 and provide the energy signals FIRE1, FIRE2 . . . FIRE6 to corresponding fire groups 202*a*-202*f*. Fire line 214*a* is electrically coupled to all pre-charged firing cells 120 in FG1 202*a*. Fire line 214*b* is electrically coupled to all pre-charged firing cells 120 in FG2 202*b* and so on, up to and including fire line 214*f* that is electrically coupled to all pre-charged firing cells 120 in FG6 202*f*. Each of the fire lines 214*a*-214*f* is electrically coupled to all of the firing resistors 52 in the corresponding fire group 202*a*-202*f*, and all pre-charged firing cells 120 in a fire group 202*a*-202*f* are electrically coupled to only one fire line 214*a*-214*f*. The fire lines 214*a*-214*f* are electrically coupled to external supply circuitry by appropriate interface pads. (See, FIG. 25). All pre-charged firing cells 120 in array 200 are electrically coupled to a reference line 216 that is tied to a reference voltage, such as ground. Thus, the pre-charged firing cells 120 in a row subgroup of pre-charged firing cells 120 are electrically coupled to the same address lines 206*a*-206*g*, pre-charge line 210*a*-210*f*, select line 212*a*-212*f* and fire line 214*a*-214*f*.

In operation, in one embodiment fire groups 202*a*-202*f* are selected to fire in succession. FG1 202*a* is selected before FG2 202*b*, which is selected before FG3 and so on, up to FG6 202*f*. After FG6 202*f*, the fire group cycle starts over with FG1 202*a*. However, other sequences, and non-sequential selections may be utilized.

The address signals ~A1, ~A2 . . . ~A7 cycle through the 13 row subgroup addresses before repeating a row subgroup address. The address signals ~A1, ~A2 . . . ~A7 provided on address lines 206*a*-206*g* are set to one row subgroup address during each cycle through the fire groups 202*a*-202*f*. The address signals ~A1 ~A2 . . . ~A7 select one row subgroup in each of the fire groups 202*a*-202*f* for one cycle through the fire groups 202*a*-202*f*. For the next cycle through fire groups 202*a*-202*f*, the address signals ~A1, ~A2 . . . ~A7 are changed to select another row subgroup in each of the fire groups 202*a*-202*f*. This continues up to the address signals ~A1, ~A2 . . . ~A7 selecting the last row subgroup in fire groups 202*a*-202*f*. After the last row subgroup, address signals ~A1, ~A2 . . . ~A7 select the first row subgroup to begin the address cycle over again.

In another aspect of operation, one of the fire groups 202*a*-202*f* is operated by providing a pre-charge signal PRE1, PRE2 . . . PRE6 on the pre-charge line 210*a*-210*f* of the one fire group 202*a*-202*f*. The pre-charge signal PRE1, PRE2 . . . PRE6 defines a pre-charge time interval or period during which time the node capacitance 126 on each drive switch 172 in the one fire group 202*a*-202*f* is charged to a high voltage level, to pre-charge the one fire group 202*a*-202*f*.

Address signals ~A1, ~A2 . . . ~A7 are provided on address lines 206*a*-206*g* to address one row subgroup in each of the fire groups 202*a*-202*f*, including one row subgroup in the pre-charged fire group 202*a*-202*f*. Data signals ~D1, ~D2 . . . ~D8 are provided on data lines 208*a*-208*h* to provide data to all fire groups 202*a*-202*f*, including the addressed row subgroup in the pre-charged fire group 202*a*-202*f*.

Next, a select signal SEL1, SEL2 . . . SEL6 is provided on the select line 212a-212f of the pre-charged fire group 202a-202f to select the pre-charged fire group 202a-202f. The select signal SEL1, SEL2 . . . SEL6 defines a discharge time interval for discharging the node capacitance 126 on each drive switch 172 in a pre-charged firing cell 120 that is either not in the addressed row subgroup in the selected fire group 202a-202f or addressed in the selected fire group 202a-202f and receiving a high level data signal ~D1, ~D2 . . . ~D8. The node capacitance 126 does not discharge in pre-charged firing cells 120 that are addressed in the selected fire group 202a-202f and receiving a low level data signal ~D1, ~D2 . . . ~D8. A high voltage level on the node capacitance 126 turns the drive switch 172 on (conducting).

After drive switches 172 in the selected fire group 202a-202f are set to conduct or not conduct, an energy pulse or voltage pulse is provided on the fire line 214a-214f of the selected fire group 202a-202f. Pre-charged firing cells 120 that have conducting drive switches 172, conduct current through the firing resistor 52 to heat ink and eject ink from the corresponding drop generator 60.

With fire groups 202a-202f operated in succession, the select signal SEL1, SEL2 . . . SEL6 for one fire group 202a-202f is used as the pre-charge signal PRE1, PRE2 . . . PRE6 for the next fire group 202a-202f. The pre-charge signal PRE1, PRE2 . . . PRE6 for one fire group 202a-202f precedes the select signal SEL1, SEL2 . . . SEL6 and energy signal FIRE1, FIRE2 . . . FIRE6 for the one fire group 202a-202f. After the pre-charge signal PRE1, PRE2 . . . PRE6, data signals ~D1, ~D2 . . . ~D8 are multiplexed in time and stored in the addressed row subgroup of the one fire group 202a-202f by the select signal SEL1, SEL2 . . . SEL6. The select signal SEL1, SEL2 . . . SEL6 for the selected fire group 202a-202f is also the pre-charge signal PRE1, PRE2 . . . PRE6 for the next fire group 202a-202f. After the select signal SEL1, SEL2 . . . SEL6 for the selected fire group 202a-202f is complete, the select signal SEL1, SEL2 . . . SEL6 for the next fire group 202a-202f is provided. Pre-charged firing cells 120 in the selected subgroup fire or heat ink based on the stored data signal ~D1, ~D2 . . . ~D8 as the energy signal FIRE1, FIRE2 . . . FIRE6, including an energy pulse, is provided to the selected fire group 202a-202f.

Figure 8:
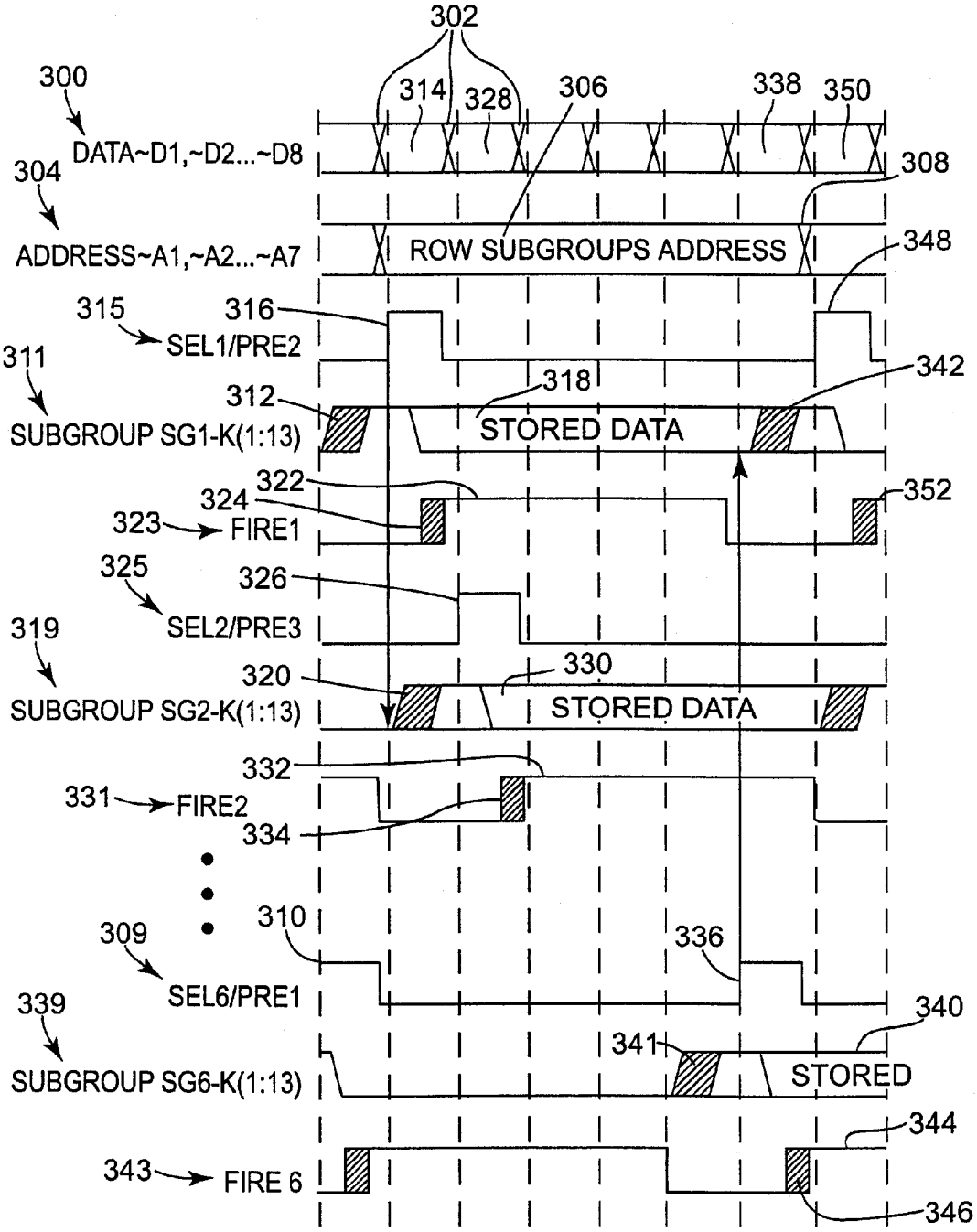
FIG. 8 is a timing diagram illustrating the operation of one embodiment of a firing cell array.

FIG. 8 is a timing diagram illustrating the operation of one embodiment of firing cell array 200. Fire groups 202a-202f are selected in succession to energize pre-charged firing cells 120 based on data signals ~D1, ~D2 . . . ~D8, indicated at 300. The data signals ~D1, ~D2 . . . ~D8 at 300 are changed depending on the nozzles that are to eject fluid, indicated at 302, for each row subgroup address and fire group 202a-202f combination. Address signals ~A1, ~A2 . . . ~A7 at 304 are provided on address lines 206a-206g to address one row subgroup from each of the fire groups 202a-202f. The address signals ~A1, ~A2 . . . ~A7 at 304 are set to one address, indicated at 306, for one cycle through fire groups 202a-202f. After the cycle is complete, the address signals ~A1, ~A2 . . . ~A7 at 304 are changed at 308 to address a different row subgroup from each of the fire groups 202a-202f. The address signals ~A1, ~A2 . . . ~A7 at 304 increment through the row subgroups to address the row subgroups in sequential order from one to 13 and back to one. In other embodiments, address signals ~A1, ~A2 . . . ~A7 at 304 can be set to address row subgroups in any suitable order.

During a cycle through fire groups 202a-202f, select line 212f coupled to FG6 202f and pre-charge line 210a coupled to FG1 202a receive SEL6/PRE1 signal 309, including SEL6/PRE1 signal pulse 310. In one embodiment, the select line 212f and pre-charge line 210a are electrically coupled together to receive the same signal. In another embodiment, the select line 212f and pre-charge line 210a are not electrically coupled together, but receive similar signals.

The SEL6/PRE1 signal pulse at 310 on pre-charge line 210a, pre-charges all firing cells 120 in FG1 202a. The node capacitance 126 for each of the pre-charged firing cells 120 in FG1 202a is charged to a high voltage level. The node capacitances 126 for pre-charged firing cells 120 in one row subgroup SG1-K, indicated at 311, are pre-charged to a high voltage level at 312. The row subgroup address at 306 selects subgroup SG1-K, and a data signal set at 314 is provided to data transistors 136 in all pre-charged firing cells 120 of all fire groups 202a-202f, including the address selected row subgroup SG1-K.

The select line 212a for FG1 202a and pre-charge line 210b for FG2 202b receive the SEL1/PRE2 signal 315, including the SEL1/PRE2 signal pulse 316. The SEL1/PRE2 signal pulse 316 on select line 212a turns on the select transistor 130 in each of the pre-charged firing cells 120 in FG1 202a. The node capacitance 126 is discharged in all pre-charged firing cells 120 in FG1 202a that are not in the address selected row subgroup SG1-K. In the address selected row subgroup SG1-K, data at 314 are stored, indicated at 318, in the node capacitances 126 of the drive switches 172 in row subgroup SG1-K to either turn the drive switch on (conducting) or off (non-conducting).

The SEL1/PRE2 signal pulse at 316 on pre-charge line 210b, pre-charges all firing cells 120 in FG2 202b. The node capacitance 126 for each of the pre-charged firing cells 120 in FG2 202b is charged to a high voltage level. The node capacitances 126 for pre-charged firing cells 120 in one row subgroup SG2-K, indicated at 319, are pre-charged to a high voltage level at 320. The row subgroup address at 306 selects subgroup SG2-K, and a data signal set at 328 is provided to data transistors 136 in all pre-charged firing cells 120 of all fire groups 202a-202f, including the address selected row subgroup SG2-K.

The fire line 214a receives energy signal FIRE1, indicated at 323, including an energy pulse at 322 to energize firing resistors 52 in pre-charged firing cells 120 that have conductive drive switches 172 in FG1 202a. The FIRE1 energy pulse 322 goes high while the SEL1/PRE2 signal pulse 316 is high and while the node capacitance 126 on non-conducting drive switches 172 are being actively pulled low, indicated on energy signal FIRE1 323 at 324. Switching the energy pulse 322 high while the node capacitances 126 are actively pulled low, prevents the node capacitances 126 from being inadvertently charged through the drive switch 172 as the energy pulse 322 goes high. The SEL1/PRE2 signal 315 goes low and the energy pulse 322 is provided to FG1 202a for a predetermined time to heat ink and eject the ink through nozzles 34 corresponding to the conducting pre-charged firing cells 120.

The select line 212b for FG2 202b and pre-charge line 210c for FG3 202c receive SEL2/PRE3 signal 325, including SEL2/PRE3 signal pulse 326. After the SEL1/PRE2 signal pulse 316 goes low and while the energy pulse 322 is high, the SEL2/PRE3 signal pulse 326 on select line 212b turns on select transistor 130 in each of the pre-charged firing cells 120 in FG2 202b. The node capacitance 126 is discharged on all pre-charged firing cells 120 in FG2 202b that are not in the address selected row subgroup SG2-K. Data signal set 328 for subgroup SG2-K is stored in the pre-charged firing cells 120 of subgroup SG2-K, indicated at 330, to either turn the drive switches 172 on (conducting) or off (non-conducting). The SEL2/PRE3 signal pulse on pre-charge line 210c pre-charges all pre-charged firing cells 120 in FG3 202c.

Fire line 214*b* receives energy signal FIRE2, indicated at 331, including energy pulse 332, to energize firing resistors 52 in pre-charged firing cells 120 of FG2 202*b* that have conducting drive switches 172. The FIRE2 energy pulse 332 goes high while the SEL2/PRE3 signal pulse 326 is high, indicated at 334. The SEL2/PRE3 signal pulse 326 goes low and the FIRE2 energy pulse 332 remains high to heat and eject ink from the corresponding drop generator 60.

After the SEL2/PRE3 signal pulse 326 goes low and while the energy pulse 332 is high, a SEL3/PRE4 signal is provided to select FG3 202*c* and pre-charge FG4 202*d*. The process of pre-charging, selecting and providing an energy signal, including an energy pulse, continues up to and including FG6 202*f*.

The SEL5/PRE6 signal pulse on pre-charge line 210*f*, pre-charges all firing cells 120 in FG6 202*f*. The node capacitance 126 for each of the pre-charged firing cells 120 in FG6 202*f* is charged to a high voltage level. The node capacitances 126 for pre-charged firing cells 120 in one row subgroup SG6-K, indicated at 339, are pre-charged to a high voltage level at 341. The row subgroup address at 306 selects subgroup SG6-K, and data signal set 338 is provided to data transistors 136 in all pre-charged firing cells 120 of all fire groups 202*a*-202*f*, including the address selected row subgroup SG6-K.

The select line 212*f* for FG6 202*f* and pre-charge line 210*a* for FG1 202*a* receive a second SEL6/PRE1 signal pulse at 336. The second SEL6/PRE1 signal pulse 336 on select line 212*f* turns on the select transistor 130 in each of the pre-charged firing cells 120 in FG6 202*f*. The node capacitance 126 is discharged in all pre-charged firing cells 120 in FG6 202*f* that are not in the address selected row subgroup SG6-K. In the address selected row subgroup SG6-K, data 338 are stored at 340 in the node capacitances 126 of each drive switch 172 to either turn the drive switch on or off.

The SEL6/PRE1 signal on pre-charge line 210*a*, pre-charges node capacitances 126 in all firing cells 120 in FG1 202*a*, including firing cells 120 in row subgroup SG1-K, indicated at 342, to a high voltage level. The firing cells 120 in FG1 202*a* are pre-charged while the address signals ~A1, ~A2 . . . ~A7 304 select row subgroups SG1-K, SG2-K and on, up to row subgroup SG6-K.

The fire line 214*f* receives energy signal FIRE6, indicated at 343, including an energy pulse at 344 to energize fire resistors 52 in pre-charged firing cells 120 that have conductive drive switches 172 in FG6 202*f*. The energy pulse 344 goes high while the SEL6/PRE1 signal pulse 336 is high and node capacitances 126 on non-conducting drive switches 172 are being actively pulled low, indicated at 346. Switching the energy pulse 344 high while the node capacitances 126 are actively pulled low, prevents the node capacitances 126 from being inadvertently charged through drive switch 172 as the energy pulse 344 goes high. The SEL6/PRE1 signal pulse 336 goes low and the energy pulse 344 is maintained high for a predetermined time to heat ink and eject ink through nozzles 34 corresponding to the conducting pre-charged firing cells 120.

After the SEL6/PRE1 signal pulse 336 goes low and while the energy pulse 344 is high, address signals ~A1, ~A2 . . . ~A7 304 are changed at 308 to select another set of subgroups SG1-K+1, SG2-K+1 and so on, up to SG6-K+1. The select line 212*a* for FG1 202*a* and pre-charge line 210*b* for FG2 202*b* receive a SEL1/PRE2 signal pulse, indicated at 348. The SEL1/PRE2 signal pulse 348 on select line 212*a* turns on the select transistor 130 in each of the pre-charged firing cells 120 in FG1 202*a*. The node capacitance 126 is discharged in all pre-charged firing cells 120 in FG1 202*a* that are not in the address selected subgroup SG1-K+1. Data signal set 350 for row subgroup SG1-K+1 is stored in the pre-charged firing cells 120 of subgroup SG1-K+1 to either turn drive switches 172 on or off. The SEL1/PRE2 signal pulse 348 on pre-charge line 210*b* pre-charges all firing cells 120 in FG2 202*b*.

The fire line 214*a* receives energy pulse 352 to energize firing resistors 52 and pre-charged firing cells 120 of FG1 202*a* that have conducting drive switches 172. The energy pulse 352 goes high while the SEL1/PRE2 signal pulse at 348 is high. The SEL1/PRE2 signal pulse 348 goes low and the energy pulse 352 remains high to heat and eject ink from corresponding drop generators 60. The process continues until printing is complete.

Figure 9:
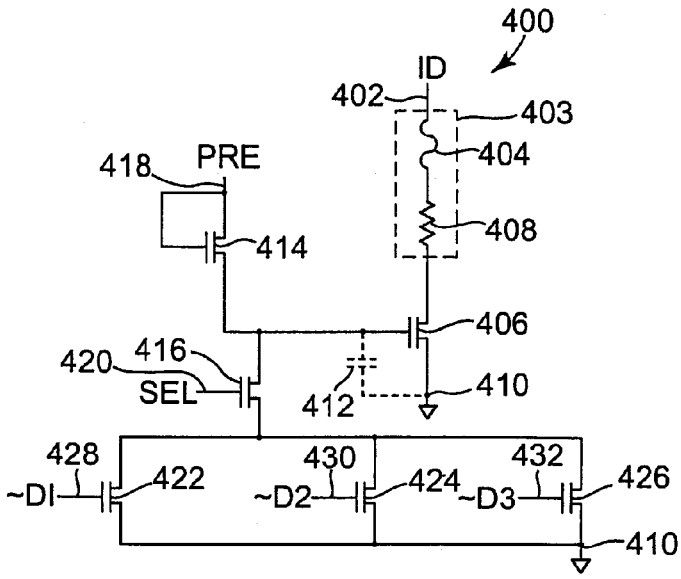
FIG. 9 is a schematic diagram illustrating one embodiment of an identification cell in one embodiment of a printhead die.

FIG. 9 is a schematic diagram illustrating one embodiment of an identification cell 400 in one embodiment of a printhead die 40. The printhead die 40 includes a plurality of identification cells electrically coupled to one identification line 402. The identification line 402 receives an identification signal ID and provides the identification signal ID to the identification cells. Each of the identification cells is similar to identification cell 400.

The identification cell 400 includes a memory element, indicated at 403. The memory element 403 stores one bit of information. In one embodiment, memory element 403 is a fuse represented by fuse element 404 and fuse resistance 408. In other embodiments, memory element 403 can be another suitable memory element, for example an anti-fuse that provides a high resistive state before being programmed and a low resistive state after being programmed with a program signal.

The identification cell 400 includes a drive switch 406 electrically coupled to memory element 403. In one embodiment, drive switch 406 is a FET including a drain-source path electrically coupled at one end to one terminal of memory element 403 and at the other end to a reference 410, such as ground. The other terminal of memory element 403 is electrically coupled to identification line 402. The identification line 402 receives identification signal ID and provides identification signal ID to memory element 403. The identification signal ID, including the program signal and the read signal, can be conducted through memory element 403 if drive switch 406 is turned on (conducting). This allows for only specific identification cells 400 on a single identification line 402 to respond to read and programming signals on the identification line 402, while other identification cells on the same identification line 402 do not respond to the read and programming signals.

The gate of drive switch 406 forms storage node capacitance 412, which functions as a memory to store charge pursuant to the sequential activation of pre-charge transistor 414 and select transistor 416. The drain-source path and gate of pre-charge transistor 414 are electrically coupled to pre-charge line 418 that receives a pre-charge signal PRE. In one embodiment, pre-charge line 418 is electrically connected to one of the pre-charge lines 210, (FIG. 7).

The gate of drive switch 406 is a control input that is electrically coupled to the drain-source path of pre-charge transistor 414 and the drain-source path of select transistor 416. The gate of select transistor 416 is electrically coupled to select line 420 that receives a select signal SEL. In one embodiment, select line 420 is electrically connected to one of the select lines 212, (FIG. 7). The storage node capacitance 412 is shown in dashed lines, as it is part of drive switch 406. Alternatively, a capacitor separate from drive switch 406 can be used to store charge.

A first transistor 422, a second transistor 424 and a third transistor 426 include drain-source paths that are electrically coupled in parallel. The parallel combination of first transistor 422, second transistor 424 and third transistor 426 is electrically coupled between the drain-source path of select transistor 416 and reference 410. The serial circuit including select transistor 416 coupled to the parallel combination of first transistor 422, second transistor 424 and third transistor 426 is electrically coupled across node capacitance 412 of drive switch 406. The gate of first transistor 422 is electrically coupled to data line 428 that receives data signal ~D1. The gate of second transistor 424 is electrically coupled to data line 430 that receives data signal ~D2 and the gate of third transistor 426 is electrically coupled to data line 432 that receives data signal ~D3. The data signals ~D1, ~D2 and ~D3 are active low as indicated by the tilda (~) preceding each signal name. The drive switch 406 including node capacitance 412, pre-charge transistor 414, select transistor 416, first transistor 422, second transistor 424 and third transistor 426 form a dynamic memory circuit or cell.

In one embodiment, data signals ~D1, ~D2 and ~D3 provided to identification cell 400 are data signals ~D1, ~D2 and ~D3 provided on data lines 208*a*-208*c* to all fire groups 202*a*-202*f* (FIG. 7). Also, in one embodiment, pre-charge signal PRE is pre-charge signal PRE1 provided on pre-charge line 210*a* to fire group 202*a*. In addition, in one embodiment, select signal SEL is select signal SEL1 provided on select line 212*a* to fire group 202*a*.

To program memory element 403, identification cell 400 receives enabling signaling, including pre-charge signal PRE, select signal SEL and data signals ~D1, ~D2 and ~D3 to turn on drive switch 406. Identification line 402 provides the program signal in the identification signal ID to memory element 403. The program signal provides a current through memory element 403 to the conducting drive switch 406 and reference 410. The program signal changes the state of memory element 403 from the low resistive state to the high resistive state. In one embodiment, the program signal is a fourteen volt signal provided for one micro-second.

To read the state of memory element 403, identification cell 400 receives enabling signaling, including pre-charge signal PRE, select signal SEL and data signals ~D1, ~D2 and ~D3 to turn on drive switch 405. Identification line 402 provides the read signal in the identification signal ID to memory element 403. The read signal provides a current through memory element 403 to the conducting drive switch 406 and reference 410. The voltage on identification line 402 is determined to determine the resistive state of memory element 403. In one embodiment, memory element 403 is determined to be in the high resistive state if the resistance is greater than about 1000 ohms and in the low resistive state if the resistance is less than about 400 ohms.

In operation, node capacitance 412 is pre-charged through pre-charge transistor 414 by providing a high level voltage pulse in pre-charge signal PRE on pre-charge line 418. After charging node capacitance 412, a data signal ~D1 is provided on data line 428 to set the on/off state of first transistor 422, data signal ~D2 is provided on data line 430 to set the on/off state of second transistor 424 and data signal ~D3 is provided on data line 432 to set the on/off state of third transistor 426. After the high level voltage pulse in pre-charge signal PRE and after pre-charge signal PRE returns to a low voltage level, a high level voltage pulse is provided in select signal SEL on select line 420 to turn on select transistor 416. Node capacitance 412 is actively discharged if at least one of the first, second, and third transistors 422, 424 and 426 is turned on by one of the data signals ~D1, ~D2 or ~D3, respectively. Alternatively, node capacitance 412 remains charged if first transistor 422, second transistor 424 and third transistor 426 are turned off by data signals ~D1, ~D2 or ~D3. A charged node capacitance 412 turns on drive switch 406 and memory element 403 can be programmed with a program signal and read with a read signal.

In one embodiment, the program signal and/or read signal are initiated while node capacitance 412 is actively discharged through select transistor 416 and at least one of the first, second and third transistors 422, 424 and 426. The high level voltage pulse in select signal SEL overlaps the start of the program signal and/or read signal on identification line 402. Also, valid data signals ~D1, ~D2 and ~D3 overlap the start of the program signal and/or read signal on identification line 402.

In one embodiment, node capacitance 412 is actively discharged through select transistor 416 and at least one of the first, second and third transistors 422, 424 and 426 during the entire program signal and/or the entire read signal. The high level voltage pulse in select signal SEL overlaps the entire program signal and/or read signal on identification line 402. Also, valid data signals ~D1, ~D2 and ~D3 overlap the entire program signal and/or read signal on identification line 402. Actively discharging node capacitance 412 during at least the rise time of the program signal and/or the rise time of the read signal prevents node capacitance 412 from being inadvertently charged to turn on a drive switch 406.

Identification cell 400 is selected and addressed for programming and reading if data signals ~D1, ~D2 and ~D3 are low and node capacitance 412 remains charged to turn on drive switch 406. Identification cell 400 is not selected for programming or reading if at least one of the data signals ~D1, ~D2 and ~D3 are high and node capacitance 412 discharges to turn off drive switch 406. The first, second and third transistors 422, 424 and 426 comprise a decoder that controls the voltage level on node capacitance 412.

In one embodiment, data signals ~D1, ~D2 . . . ~D8 provided on data lines 208*a*-208*h* to fire groups 202*a*-202*f* (shown in FIG. 7) are provided to identification cells 400, in printhead die 40. With three of eight data signals ~D1, ~D2 . . . ~D8 selecting each identification cell 400 in a plurality of identification cells, up to fifty six different identification cells can be selected by the eight data signals ~D1, ~D2 . . . ~D8. The combination of the eight data signals ~D1, ~D2 . . . ~D8, in reverse order, that, in one embodiment, are utilized to activate each individual identification cell 400, are shown in the following Table I:

TABLE I

| IDCell: ~D8-~D1 |
|---|
| 1: 11111000 |
| 2: 11110100 |
| 3: 11101100 |
| 4: 11011100 |
| 5: 10111100 |
| 6: 01111100 |
| 7: 11110010 |
| 8: 11101010 |
| 9: 11011010 |
| 10: 10111010 |
| 11: 01111010 |
| 12: 11100110 |
| 13: 11010110 |
| 14: 10110110 |
| 15: 01110110 |
| 16: 11001110 |
| 17: 10101110 |
| 18: 01101110 |
| 19: 10011110 |
| 20: 01011110 |
| 21: 00111110 |

TABLE I-continued

| IDCell: ~D8-~D1 |
|---|
| 22: 11110001 |
| 23: 11101001 |
| 24: 11011001 |
| 25: 10111001 |
| 26: 01111001 |
| 27: 11100101 |
| 28: 11010101 |
| 29: 10110101 |
| 30: 01110101 |
| 31: 11001101 |
| 32: 10101101 |
| 33: 01101101 |
| 34: 10011101 |
| 35: 01011101 |
| 36: 00111101 |
| 37: 11100011 |
| 38: 11010011 |
| 39: 10110011 |
| 40: 01110011 |
| 41: 11001011 |
| 42: 10101011 |
| 43: 01101011 |
| 44: 10011011 |
| 45: 01011011 |
| 46: 00111011 |
| 47: 11000111 |
| 48: 10100111 |
| 49: 01100111 |
| 50: 10010111 |
| 51: 01010111 |
| 52: 00110111 |
| 53: 10001111 |
| 54: 01001111 |
| 55: 00101111 |
| 56: 00011111 |

As can be seen from Table 1, each identification cell 400 can be individually enabled, and thereby can be programmed on an individual basis. Also, since the identification cells 400 can be read individually, the combinations utilized to store data are greatly increased. For example, a single identification cell 400 may be utilized in multiple combinations that each represents different information.

In one embodiment, printhead die 40 includes a pre-charge line, a select line, eight data lines, and an identification line coupled to fifty six identification cells. These eleven lines are used to control fifty six identification bits or about 5.1 identification cell bits per control line. In other embodiments, any suitable number of data signals can be provided to the identification cells. Also, in other embodiments, each identification cell can be configured to respond to any suitable number of data signals, such as two or four or more data signals. The uses for identification cells 400 can be similar to uses described for identification cells in this specification.

A plurality of identification cells, similar to identification cell 400, in an example embodiment of printhead die 40, store identification information indicating features of or other information about printhead die 40. A printer employing such a printhead having identification cells can use this identification information to optimize printing quality in a variety of printing applications. Also, the printer can use this identification information for marketing purposes, such as regional marketing and original equipment manufacturer (OEM) marketing.

In one embodiment, selected identification cells store identification information indicating a thermal sense resistance value as determined at a selected temperature, such as 32 degrees centigrade. In this embodiment, a printhead includes a thermal sense resistor (TSR) that is read to provide a TSR value. The TSR is read and the obtained value is compared to the thermal sense resistance value stored in the identification cells to determine the temperature of the printhead. Printers can use this TSR information to optimize printing quality.

In one embodiment, selected identification cells store identification information indicating a printhead uniqueness number. The printer can use the printhead uniqueness number, along with other identification information, to identify and properly respond to the printhead.

In one embodiment, selected identification cells store identification information indicating an ink drop weight for a printhead. In one embodiment, the ink drop weight is indicated as an ink drop weight delta value or change from a selected nominal ink drop weight value.

In some embodiments, identification cells store identification information not only about the printhead die, but also about the inkjet cartridge or pen in which the printhead die is inserted. For example, in one embodiment, selected identification cells store identification information indicating an out of ink detection level for an inkjet cartridge. In one embodiment, a printer accounts for the drop weight values stored in selected identification cells and the out of ink detection level information stored in other selected identification cells to determine actual out of ink detection levels.

In one embodiment, one or more selected identification cells store identification information indicating which company sells a fluid ejection device. For example, one or more selected identification cells can store identification information indicating that the fluid ejection device is sold under a certain company's brand name or not sold under that certain company's brand name.

In one embodiment, selected identification cells store identification indicating a marketing region for the fluid ejection device. In one embodiment, selected identification cells store identification information indicating the seller of an OEM fluid ejection device. In one embodiment, selected identification cells in a printhead store identification indicating whether an OEM printer is unlocked. For example, the OEM printer can respond to the OEM unlocked information to unlock an OEM printer, such that the OEM printer can accept OEM printheads sold by a given company or group of companies and printheads sold by companies other than the given company or group of companies, such as the actual original manufacturer company.

In one embodiment, selected identification cells store identification information indicating the product type and product revision of a fluid ejection device. The product type and product revision can be used by a printer to ascertain physical characteristics about a printhead. In one embodiment, product revision physical characteristics, such as spacing between nozzle columns, that may change in future products are stored in selected identification cells of a printhead. In this embodiment, the product revision physical characteristic information can be used by the printer to adjust for the physical characteristic changes between product revisions.

It should be noted that while FIG. 9 discloses utilizing a single identification line 402 that is coupled to each of the identification cells 400, e.g. 56 identification cells, more than one identification line 400 may be utilized. Also, the number of identification cells that are provided may be more or less than 56 depending of factors such as the size of the die, the operating parameters of the fluid ejection device, or other considerations. Also, the number of identification cells that are encoded with information may be less than the total number of identification cells on the die.

Also, the memory element 403 may be encoded with multiple bits of information. In such an instance, different ranges of resistance may be utilized to represent each bit. An example of a system and method for encoding a memory element with multiple bits of information is depicted and disclosed in co-pending U.S. patent application Ser. No. 10/778,415, which is incorporated herein by reference in its entirety.

Figure 10:
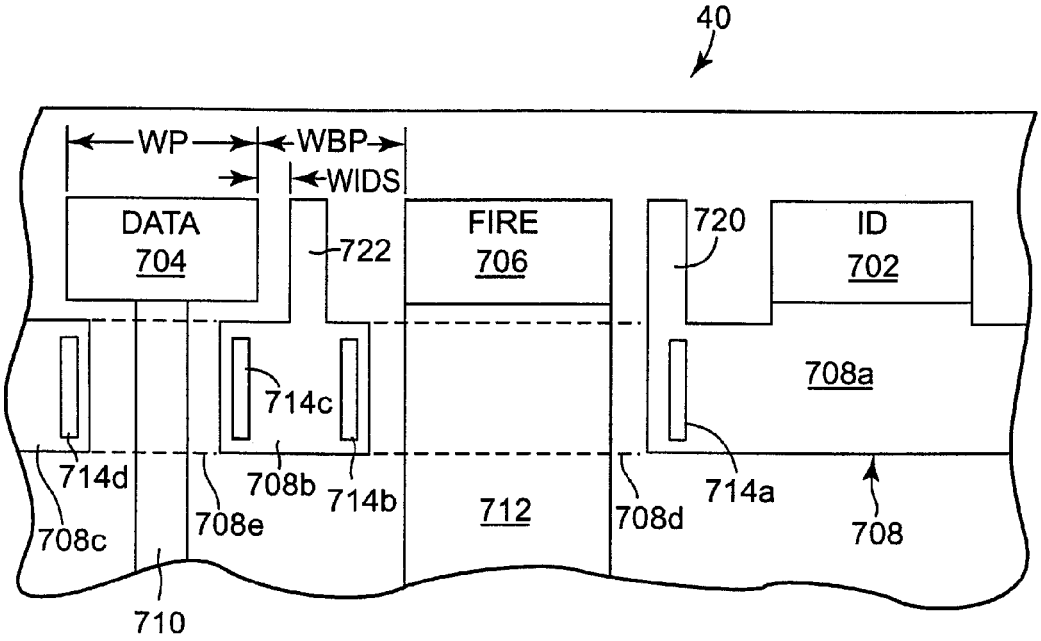
FIG. 10 is a layout diagram illustrating one embodiment of a portion of a printhead die.

FIG. 10 is a diagram illustrating one embodiment of a portion of a printhead die 40. The printhead die 40 includes an identification signal input pad 702, a data line input pad 704 and a fire line input pad 706. The identification signal input pad 702, data line input pad 704 and fire line input pad 706 are formed as part of the second metal layer of printhead die 40. The identification signal input pad 702 is electrically coupled to identification line 708 that is electrically coupled to identification cells such as identification cell 400, or other identification elements, in printhead die 40. The data line input pad 704 is electrically coupled to data line 710 that is electrically coupled to firing cells 120 in printhead die 40. The fire line input pad 706 is electrically coupled to fire line 712 that is electrically coupled to firing cells 120 in printhead die 40.

The identification line 708 includes second metal layer portions 708*a*-708*c* and first metal layer portions 708*d* and 708*e*. The second metal layer is isolated from the first metal layer by an isolation layer. Contact is made between second metal layer portions 708*a*-708*c* and first metal layer portions 708*d* and 708*e* through vias 714*a*-714*d*. Second metal layer portion 708*a* is electrically coupled to first metal layer portion 708*d* through via 714*a*. The first metal layer portion 708*d* is electrically coupled to second metal layer portion 708*b* through via 714*b*. The second metal layer portion 708*b* is electrically coupled to first metal layer portion 708*e* through via 714*c*, and first metal layer portion 708*e* is electrically coupled to second metal layer portion 708*c* through via 714*d*.

The data line 710 is formed as part of the second metal layer and disposed over first metal layer portion 708*e* of identification line 708. Fire line 712 is formed as part of the second metal layer and disposed over first metal layer portion 708*d* of identification line 708. The first metal layer is isolated from the second metal layer by the isolation layer and identification line 708 is isolated from data line 710 and from fire line 712. The data line 710 receives data signal DATA and provides data signal DATA to firing cells 120. Fire line 712 receives fire signal FIRE and provides fire signal FIRE to firing cells 120 in printhead die 40.

The second metal layer portion 708*a* includes an elongated finger portion, indicated at 720, that is situated next to fire line input pad 706, and second metal layer portion 708*b* includes an elongated finger portion, indicated at 722, that is situated next to data line input pad 704. Identification line 708 receives identification signal ID and provides identification signal ID to identification cells, such as identification cell 400, or other identification elements in printhead die 40. Also, identification line 708 receives a short detection signal in identification signal ID. The short detection signal is used to detect fluid short circuits, such as ink short circuits, between data line input pad 704 and finger portion 722, and between fire line input pad 706 and finger portion 720.

To detect a short circuit between data line input pad 704 and finger portion 722, probes are positioned on identification signal input pad 702 and data line input pad 704. The short detection signal is provided to identification signal input pad 702 and ground is provided at data line input pad 704. A short circuit is detected as a low voltage level on identification signal input pad 702. To detect a short circuit between fire line input pad 706 and finger portion 720, probes are positioned on identification signal input pad 702 and fire line input pad 706. The short detection signal is provided to identification signal input pad 702 and ground is provided at fire line input pad 704. A short circuit is detected as a low voltage level on identification signal input pad 702. This short circuit detection test can be used for each input pad that has identification line 708 situated next to it. The short circuit detection test is used as a substitute for detecting ink shorts between input pads, such as data line input pad 704 and fire line input pad 706. In one embodiment, signal input pads 702, 704 and 706 have a pad width WP of 125 microns and between pad spacing WBP of 50 microns. The spacing between finger portion 722 and data line input pad 704 at WIDS is 10 microns, and the spacing between finger portion 720 and fire line input pad 706 is 10 microns.

Examples of other identification elements or identification cells that may be utilized with layouts of identification signal input pad 702, data line input pad 704 and fire line input pad 706 are depicted and disclosed in co-pending U.S. patent application Ser. No. 09/967,028 and U.S. Pat. No. 5,363,134 both of which are incorporated by reference herein in their entirety.

Figure 11:
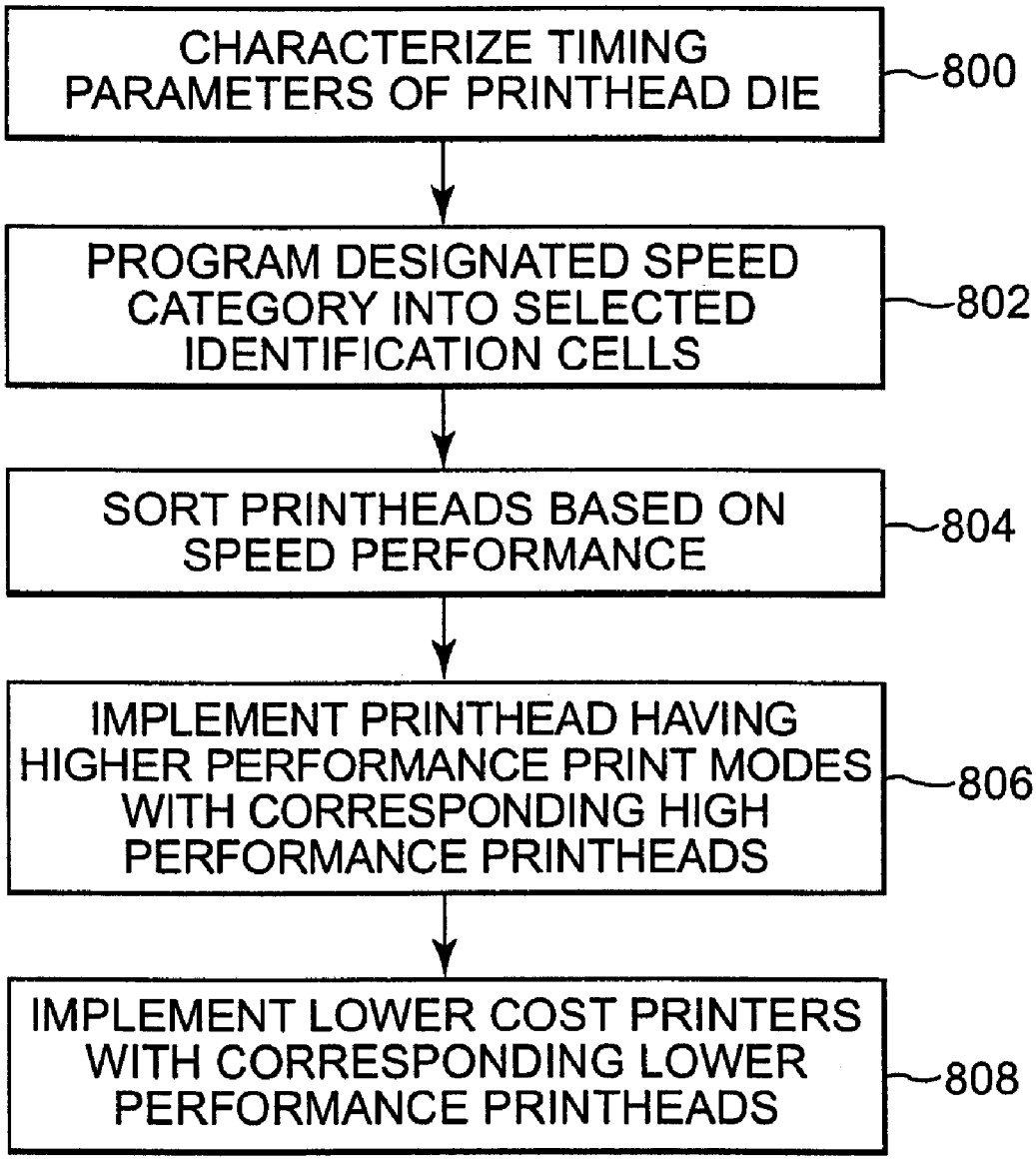
FIG. 11 is a flow chart illustrating one embodiment of a manufacturing process employing selected identification cells in certain embodiments of a printhead die.

FIG. 11 is a flow chart illustrating one embodiment of a manufacturing process employing selected identification cells in certain embodiments of printhead die 40. In certain embodiments of printhead die 40, the operating speed is dependent on the time it takes to charge and discharge internal circuit nodes. These charge and discharge times are dependent on the speed of the silicon and may vary from one printhead die 40 to the next due to slight differences in the properties of the substrate from which the printhead die 40 is formed. By characterizing the speed of a printhead die 40 and encoding the speed on the printhead die 40, after testing, applications can use some printhead die 40 in higher performance applications and other printhead die 40 in lower performance applications.

In a printhead die 40 including pre-charged firing cells 120 in a firing cell array similar to firing cell array 200 illustrated in FIG. 7, fire signals FIRE1, FIRE2 . . . FIRE6 include energy pulses that overlap as illustrated in the timing diagram of FIG. 8. The operating speed of printhead die 40 may be dependent on the time it takes to charge and discharge address lines 144 and 146 for selecting and deselecting firing cells 120, the time it takes to discharge node capacitance 126 through select transistor 130 before an energy pulse is provided in fire signal FIRE, and the time it takes to precharge node capacitance 126.

At 800, timing parameters of printhead die 40 that include pre-charged firing cells 120 in firing cell arrays similar to firing cell array 200 are characterized in testing of the printhead die 40. In each characterized printhead die 40, the characterized timing parameters include charge and discharge times of one or more address lines, such as address lines 144 and 146. Also, in each characterized printhead die 40, the characterized timing parameters include the discharge time of one or more node capacitances 126. The timing characteristics of each characterized printhead die 40 are categorized into a designated speed category.

At 802, the designated speed category of a characterized printhead die 40 is programmed into selected identification cells in the characterized printhead die 40. The identification cells in the characterized printhead die 40 are similar to identification cell 400 illustrated in FIG. 9. The selected identification cells 400 in each characterized printhead die 40 can be read at 804 and the printhead die 40 are sorted based on the speed performance category.

At 806, printhead die 40 that are categorized into higher speed performance categories are implemented in printers having higher performance print modes. At 808, printhead die 40 that are categorized into lower speed performance categories are implemented in lower performance printers, such as lower cost printers that do not include the higher performance print modes of the higher performance printers.

The operating speed of other embodiments of printhead die 40 may also be dependent on the time it takes to charge and discharge internal circuit nodes. For example, in one embodiment where dynamic firing cells are first discharged, the operating time may be dependent on the time it takes to charge the gate of the drive switch, instead of the time it takes to discharge the gate of the drive switch.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

What is claimed is:

1. A fluid ejection device comprising:

an identification line adapted to conduct a program signal and a read signal;

identification cells electrically coupled to the identification line; and a group of data lines configured to receive data representing an image and signals that selectively enable the identification cells, wherein each of the identification cells is coupled to at least two data lines in the group of data lines and adapted to conduct and respond to the signals transmitted on the at least two data lines to be selectively enabled, wherein each enabled identification cell is adapted to be programmed via the program signal and read via the read signal.

2. The fluid ejection device of claim 1, wherein one of the identification cells is configured to be enabled via the signals on the at least two data lines being in a first state.

3. The fluid ejection device of claim 2, wherein the rest of the identification cells are configured to be disabled via the signals on the rest of the group of data lines being in a second state.

4. The fluid ejection device of claim 1, wherein the at least two data lines is three data lines and one of the identification cells is configured to be enabled via the signals on the three data lines being in a first state and the rest of the identification cells are configured to be disabled via the signals on the rest of the group of data lines being in a second state.

5. A fluid ejection device, comprising:

means for receiving data representing an image and signals that selectively enable identification cells;

means for responding to the signals to provide an enabling value; and means for storing the enabling value that selectively enables the identification cells to be programmed via a program signal and read via a read signal.

6. The fluid ejection device of claim 5, further comprising:

means responsive to the program signal to store identification information.

7. The fluid ejection device of claim 5, wherein the means for storing the enabling value comprises:

means for pre-charging the identification cells; and means for discharging pre-charged identification cells.

8. The fluid ejection device of claim 5, wherein the means for storing the enabling value comprises:

means for discharging the identification cells; and means for charging discharged identification cells.

9. A fluid ejection device comprising:

a group of signal lines adapted to receive first signals, wherein the group of signal lines includes subgroups of at least three signal lines;

an identification line adapted to receive a program signal and a read signal; and identification cells electrically coupled to the identification line, wherein each of the identification cells is coupled to a corresponding one of the subgroups of at least three signal lines and adapted to respond to the first signals received on the corresponding one of the subgroups of at least three signal lines to be selectively enabled, wherein an enabled identification cell is adapted to be programmed via the program signal and read via the read signal.

10. The fluid ejection device of claim 9, wherein each of the identification cells is adapted to respond to the first signals received on the corresponding one of the subgroups of at least three signal lines being in a first state to be selectively enabled.

11. The fluid ejection device of claim 10, wherein each of the identification cells is adapted to respond to at least one of the first signals received on the corresponding one of the subgroups of at least three signal lines being in a second state to be selectively disabled.

12. The fluid ejection device of claim 9, wherein the group of signal lines is adapted to receive second signals for enabling fluid ejection at a different time than receiving the first signals.

13. The fluid ejection device of claim 9, further comprising enable lines adapted to receive enabling signaling, wherein a ratio of the number of identification cells to the number of signal lines in the group of signal lines plus the number of enable lines plus the identification line is greater than two.

14. The fluid ejection device of claim 9, further comprising enable lines adapted to receive enabling signaling, wherein a ratio of the number of identification cells to the number of signal lines in the group of signal lines plus the number of enable lines plus the identification line is greater than four.

15. A fluid ejection device comprising:

a first line adapted to receive a first pulse activated at a first time;

a second line adapted to receive a second pulse activated at a second time that is different than the first time;

a third line adapted to receive a program signal and a read signal at different times, wherein a received one of the program signal and the read signal is activated at a third time that is different than the first time and the second time; and identification cells electrically coupled to the third line, wherein one of the identification cells comprises a capacitance, is coupled to the first line and the second line, and is adapted to respond to the first pulse to charge the capacitance to a first voltage level, wherein the second pulse controls whether the capacitance is discharged and the one identification cell is adapted to respond to the capacitance being at the first voltage level at the third time to be programmed via the program signal and read via the read signal.

16. The fluid ejection device of claim 15, wherein the first pulse and the second pulse are non-overlapping pulses.

17. The fluid ejection device of claim 15, wherein the second pulse overlaps at least the activation of the received one of the program signal and the read signal.

18. The fluid ejection device of claim 15, wherein the second pulse overlaps the entire received one of the program signal and the read signal.

19. The fluid ejection device of claim 15, comprising:

a fourth line adapted to receive an enable signal and a data signal representing a portion of an image, wherein the second pulse and the enable signal selectively discharge the capacitance.

20. The fluid ejection device of claim 19, wherein the enable signal overlaps at least the activation of the received one of the program signal and the read signal.

* * * * *